US005983460A

United States Patent [19]

Hyde et al.

[11] Patent Number: 5,983,460

[45] Date of Patent: Nov. 16, 1999

[54] BAG CLOSURE

[76] Inventors: Allen L. Hyde, 1526 San Alto, Orange, Calif. 92665; Edward E. Elson, 4356 Claytor Cir, Anaheim, Calif. 92807

[21] Appl. No.: 08/798,868

[22] Filed: Feb. 11, 1997

[51] Int. Cl.[6] ..... B65D 77/10

[52] U.S. Cl. ..... 24/30.5 R; 24/555; 24/561; 24/563

[58] Field of Search ..... 24/30.5 R, 545, 24/563, 530, 11 CT, 561, 562, 30.5 P, 30.55, 56, 555; 383/68, 69, 63, 65, 42, 81, 64, 90, 78, 91, 83, 82, 89; 40/316; 248/74.2, 316.7

[56] References Cited

U.S. PATENT DOCUMENTS

| | | | |
|---|---|---|---|
| D. 305,297 | 1/1990 | O'Neill | D8/300 |
| D. 305,989 | 2/1990 | Fohrman | D9/434 |
| D. 328,187 | 7/1992 | Saurette | D3/54 |
| D. 331,364 | 12/1992 | Barker et al. | D9/434 |
| 473,337 | 4/1892 | Paige . | |
| 499,481 | 6/1893 | Swegles | 383/68 X |
| 1,513,395 | 10/1924 | Holmes . | |
| 1,590,682 | 6/1926 | Hart . | |
| 1,977,492 | 10/1934 | Schaaf | 229/54 |
| 2,021,609 | 11/1935 | Pippert | 229/65 |
| 2,032,880 | 3/1936 | Kinsley et al. | 229/37 |
| 2,061,463 | 11/1936 | Hall | 24/625 X |
| 2,064,432 | 12/1936 | Keidel | 150/3 |
| 2,259,855 | 10/1941 | Martinet | 150/6 |
| 2,319,316 | 5/1943 | Gerendas | 229/65 |
| 2,336,503 | 12/1943 | Ringler . | |
| 2,338,927 | 1/1944 | Gerendas | 229/65 |
| 2,586,931 | 2/1952 | Gammon | 24/30.5 |
| 2,599,520 | 6/1952 | Turner | 383/69 X |
| 2,629,916 | 3/1953 | Footlick | 24/255 |
| 2,909,147 | 10/1959 | Crowder | 116/173 |
| 3,086,264 | 4/1963 | Tindall | 24/30.5 |
| 3,141,221 | 7/1964 | Faulls | 24/30.5 |
| 3,266,711 | 8/1966 | Song | 220/62 |
| 3,381,883 | 5/1968 | Harris | 229/47 |
| 3,458,110 | 7/1969 | Goldman | 229/17 |
| 3,693,864 | 9/1972 | Wilkins | 229/17 |
| 5,116,139 | 5/1992 | Young et al. | 383/69 X |
| 5,301,392 | 4/1994 | Richman | 24/30.5 R |
| 5,400,929 | 3/1995 | Lopez Gonzalez | 383/69 X |
| 5,613,282 | 3/1997 | Deddens, Sr. et al. | 24/30.5 R |

FOREIGN PATENT DOCUMENTS

| | | | |
|---|---|---|---|
| 25266 | 11/1936 | Australia | 383/68 |
| 342317 | 11/1989 | European Pat. Off. | 383/68 |
| 25 17 068 | 10/1976 | Germany . | |

*Primary Examiner*—James R. Brittain

*Attorney, Agent, or Firm*—Koppel & Jacobs; Michael J. Ram

[57] ABSTRACT

A bag closure comprising a cylindrical tube having a slit along its length, a notch in line with the slit on at least one end of the tube and an elevated bead formed around at least one end of the tube, the bead functioning to maintain the tube in its cylindrical shape. The bag closure may additionally include a flange or pad to aid in attaching the bag closure to a second structure.

8 Claims, 8 Drawing Sheets

BAG CLOSURE

BACKGROUND

The present invention relates to a closure for use in obtaining a generally air tight seal on a bag. In addition the closure is inexpensive to form and easy to apply and remove. Prior art closures are of several types including mechanical clips, molded clamps and cylindrical devices prepared by slitting an extruded plastic tube. The mechanical clips and molded clamps are more expensive to fabricate than the slit tube construction. However, the slit tube construction, because of residual stresses molded into the tube, demonstrates a tendency for the slit edges to overlap each other forming a spiral configuration which is harder to use or to spread apart, each variation having less than desirable sealing properties.

Thus there is a need for a simple, lower cost design which will hold the desired cylindrical configuration during use.

SUMMARY

These needs are met by the present invention which comprises a cylindrical tube having a length approximating the length of the bag to be sealed, a slit parallel to the tube's central axis and a curled circumference on at least one end thereof.

DRAWINGS

These and other features, aspects and advantages of the present invention will become better understood with reference to the following description, appended claims, and accompanying drawings, where:

Figure 8:
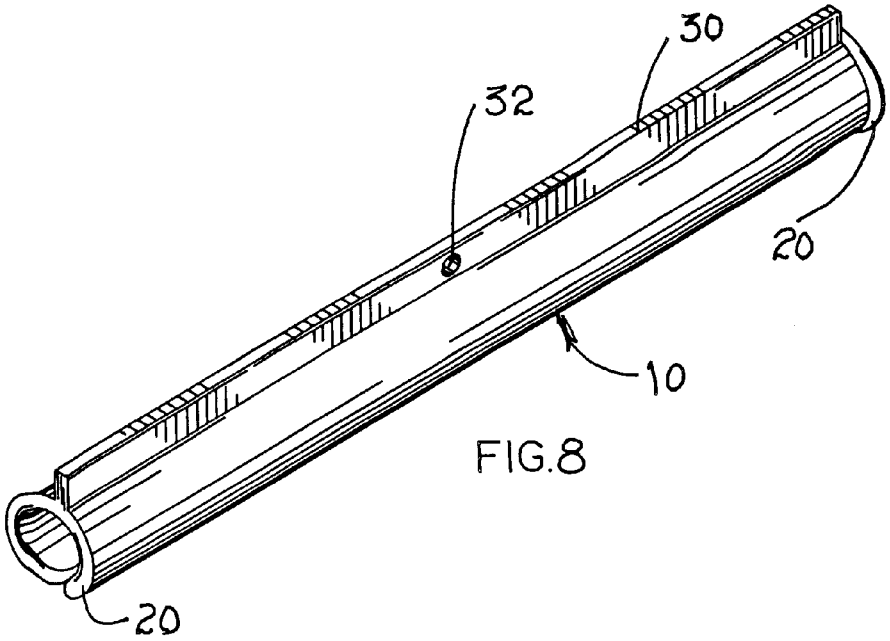
FIG. 8 is a top left perspective view of a second embodiment of a bag closure incorporating features of the invention.
Figure 9:
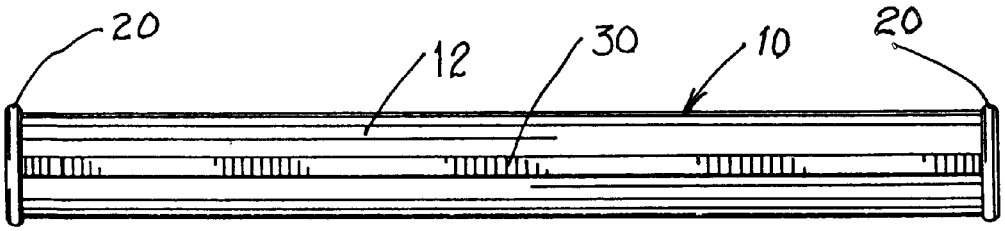
FIG. 9 is a top view of the bag closure shown in FIG. 8.
Figure 10:
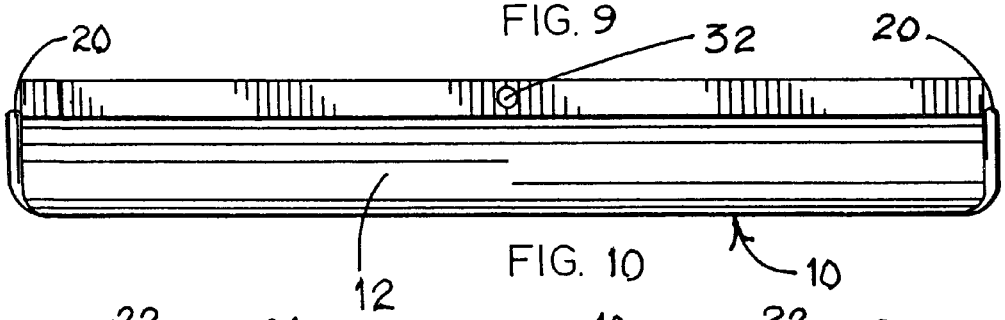
FIG. 10 is a side view of the bag closure shown in FIG. 8.
Figure 11:
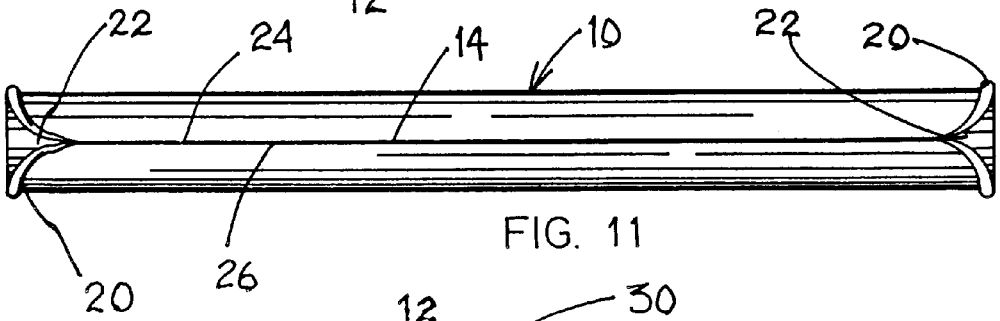
FIG. 11 is a bottom view of the bag closure shown in FIG. 8.
Figure 12:
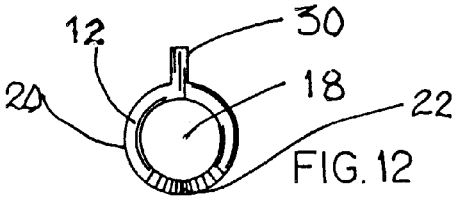

FIG. 12 an end view of the bag closure shown in FIG. 8, the opposite end being a mirror image thereof.

Figure 13:
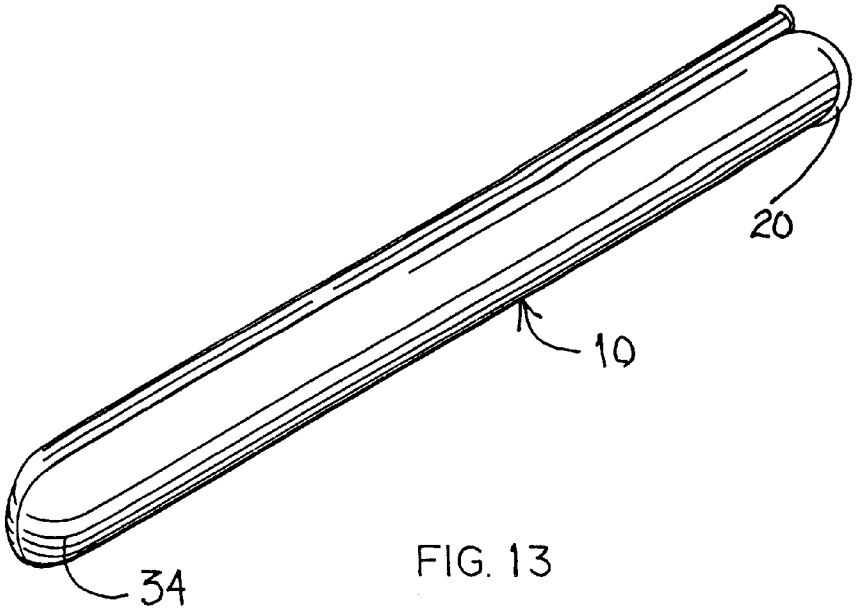

FIG. 13 is a bottom left perspective view of a third embodiment of a bag closure incorporating features of the invention.

Figure 14:
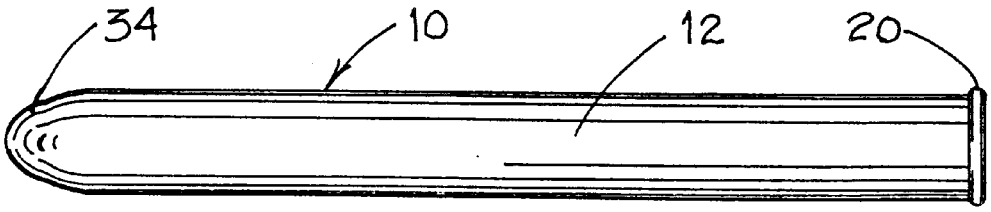

FIG. 14 is a top view of the bag closure shown in FIG. 13.

Figure 15:
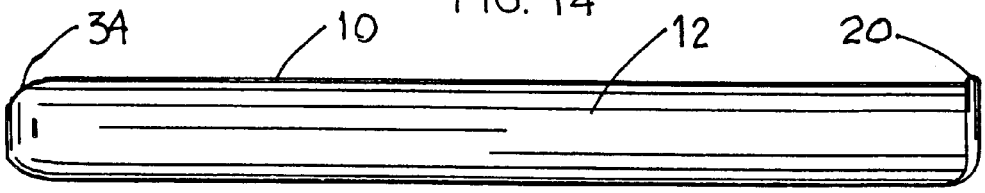

FIG. 15 is a side view of the bag closure shown in FIG. 13.

Figure 16:
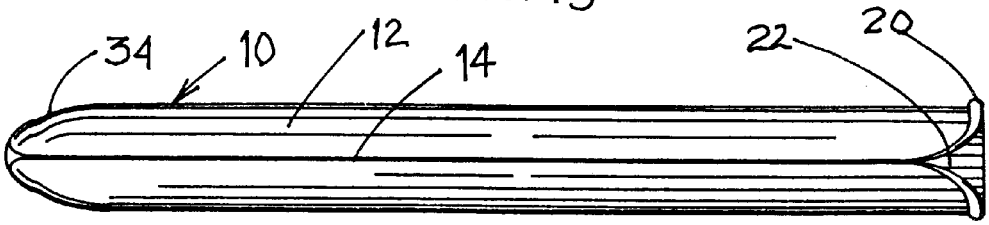

FIG. 16 is a bottom view of the bag closure shown in FIG. 13.

Figure 17:
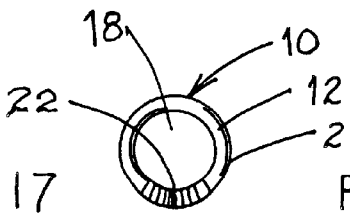

FIG. 17 is a view of the open end of the bag closure shown in FIG. 13.

Figure 18:
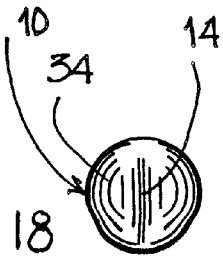

FIG. 18 is a view of the closed end of the bag closure shown in FIG. 13.

Figure 19:
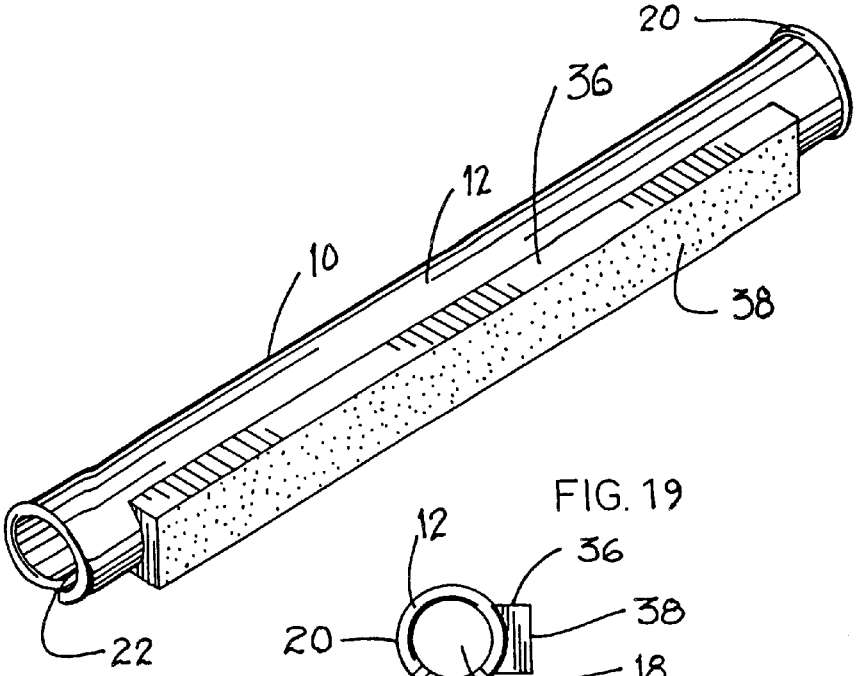

FIG. 19 is a top left perspective view of a fourth embodiment of a bag closure incorporating features of the invention.

Figure 20:
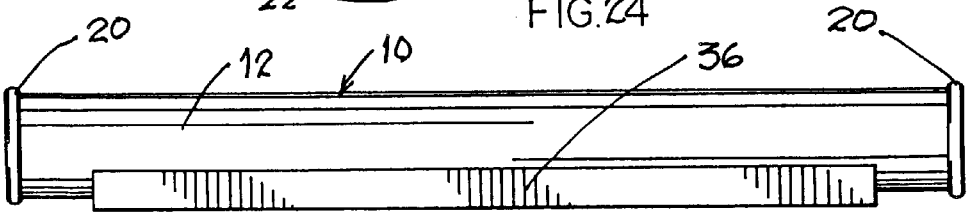

FIG. 20 is a top view of the bag closure shown in FIG. 19.

Figure 21:
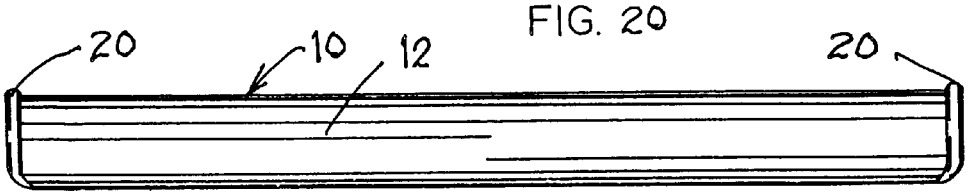

FIG. 21 is a view of a first side of the bag closure shown in FIG. 19.

Figure 22:
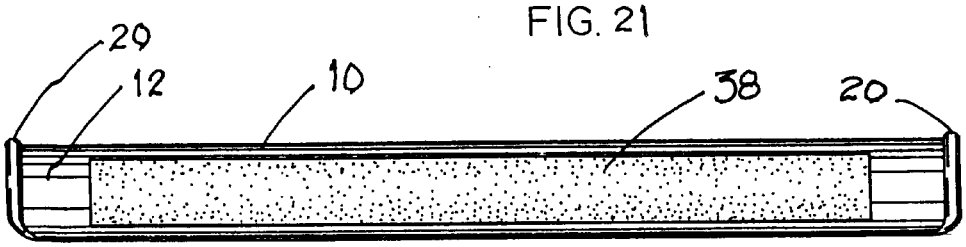

FIG. 22 is a view of a second side of the bag closure shown in FIG. 19.

Figure 23:
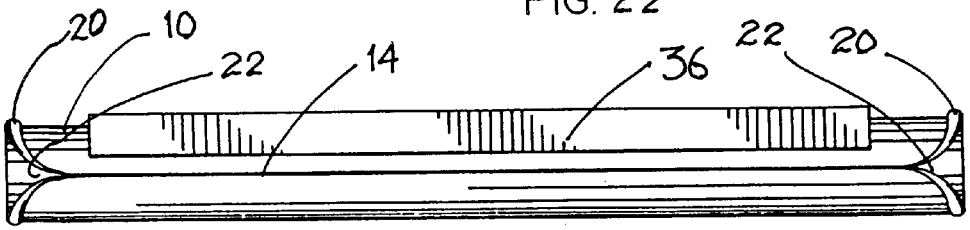

FIG. 23 is a bottom view of the bag closure shown in FIG. 19.

Figure 24:
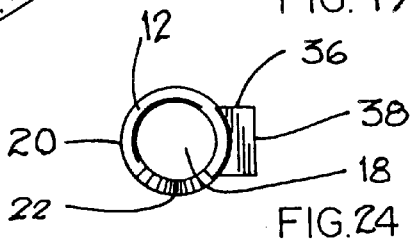

FIG. 24 is an end view of the bag closure of FIG. 19, the opposite end being a mirror image thereof.

Figure 25:
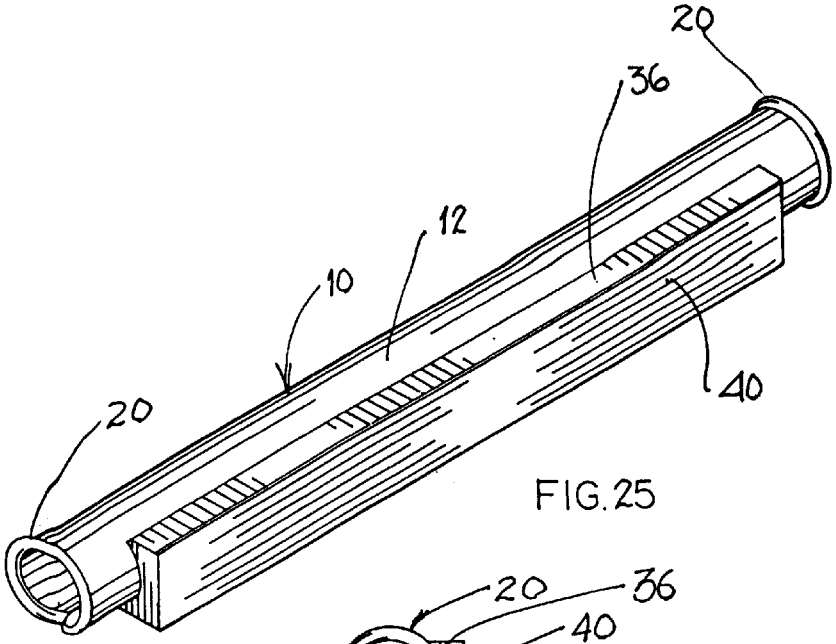

FIG. 25 is a top left perspective view of a fifth embodiment of a bag closure incorporating features of the invention.

Figure 26:
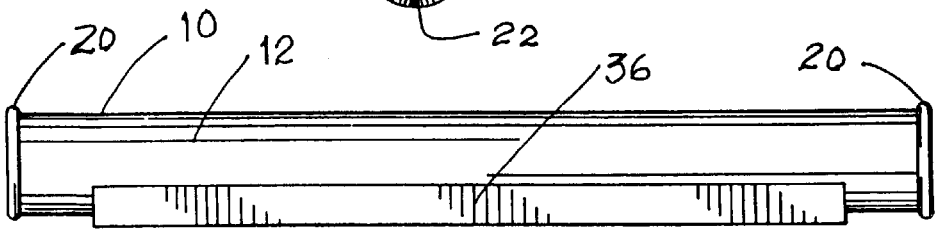

FIG. 26 is a top view of the bag closure shown in FIG. 25.

Figure 27:
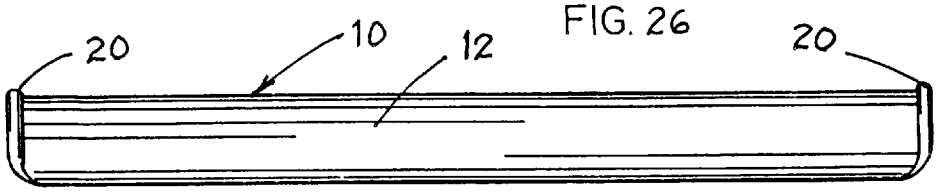

FIG. 27 is a view of a first side of the bag closure shown in FIG. 25.

Figure 28:
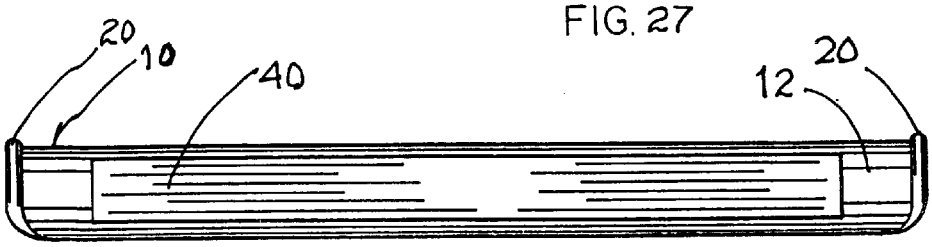

FIG. 28 is a view of a second side of the bag closure shown in FIG. 25.

Figure 29:
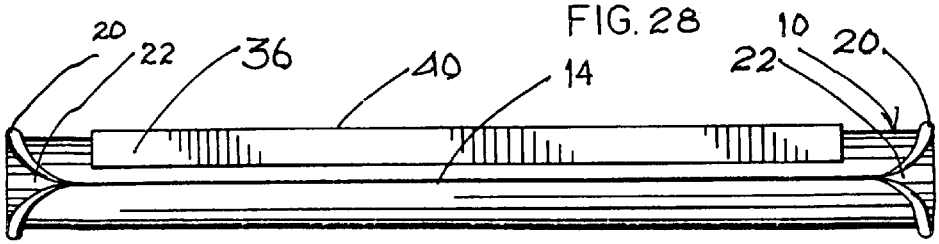

FIG. 29 is a bottom view of the bag closure shown in FIG. 25.

Figure 30:
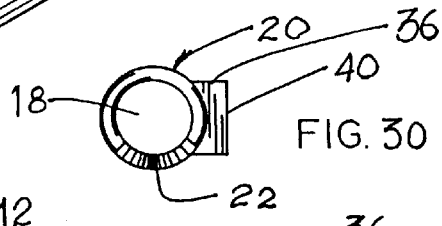

FIG. 30 is an end view of the bag closure of FIG. 25, the opposite end being a mirror image thereof.

Figure 31:
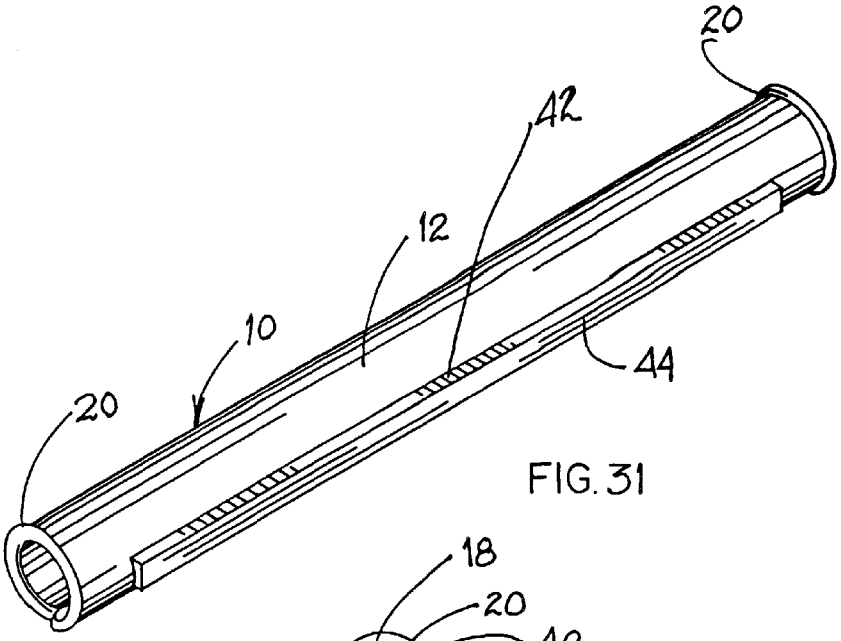

FIG. 31 is a top left perspective view of a sixth embodiment of a bag closure incorporating features of the invention.

Figure 32:
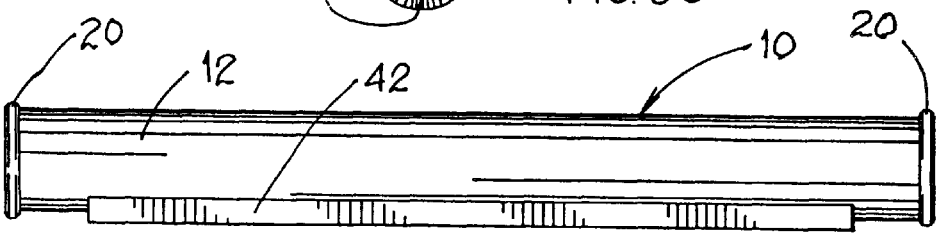

FIG. 32 is a top view of the bag closure shown in FIG. 31.

Figure 33:
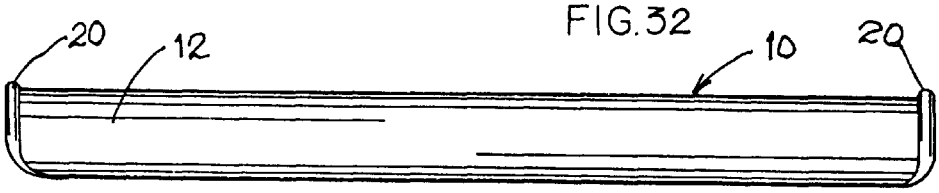

FIG. 33 is a view of a first side of the bag closure shown in FIG. 31.

Figure 34:
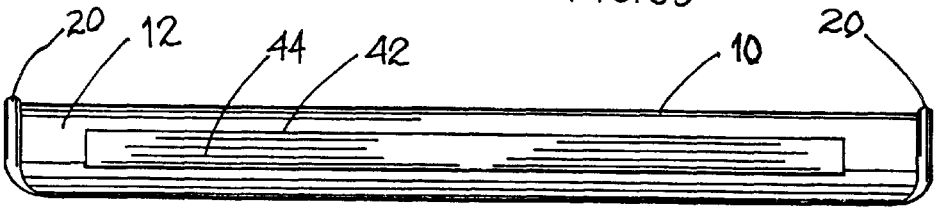

FIG. 34 is a view of a second side of the bag closure shown in FIG. 31.

Figure 35:
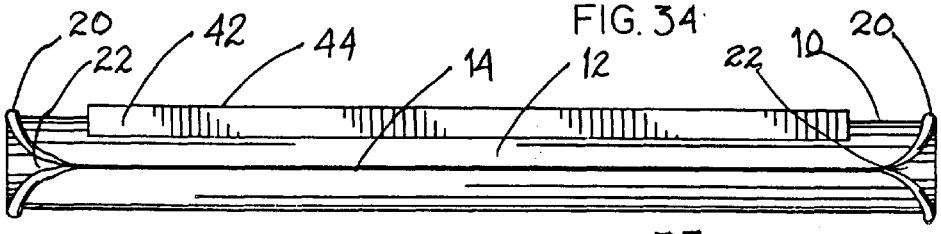

FIG. 35 is a bottom view of the bag closure shown in FIG. 31.

Figure 36:
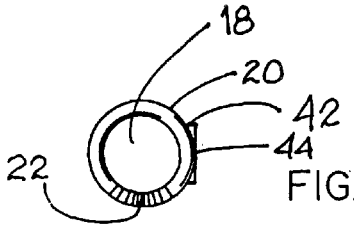

FIG. 36 is an end view of the bag closure of FIG. 31, the opposite end being a mirror image thereof.

Figure 37:
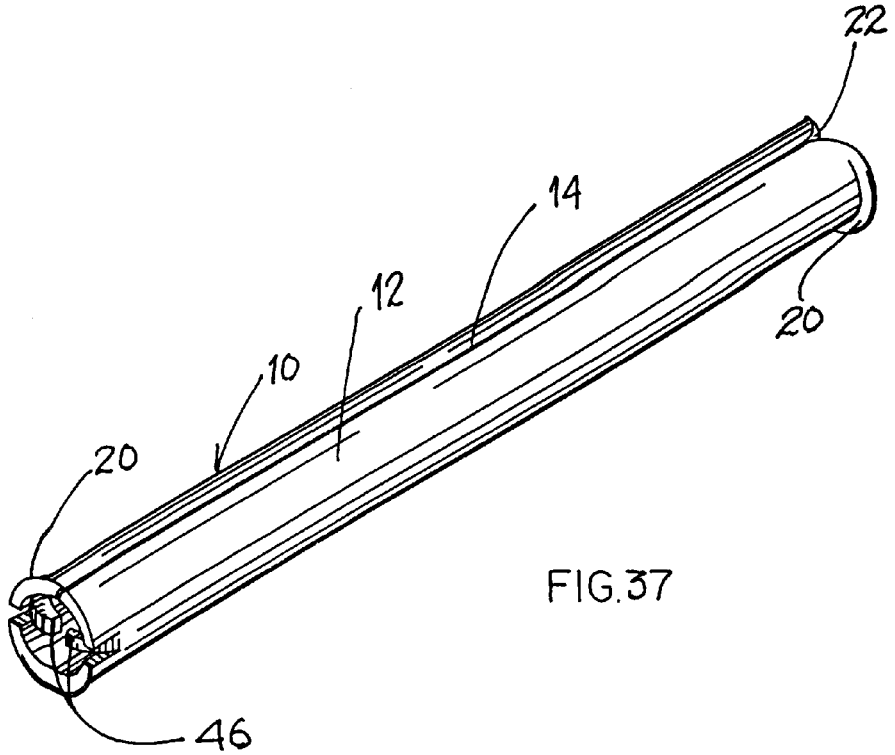

FIG. 37 is a bottom left perspective view of a seventh embodiment of a bag closure incorporating features of the invention.

Figure 38:
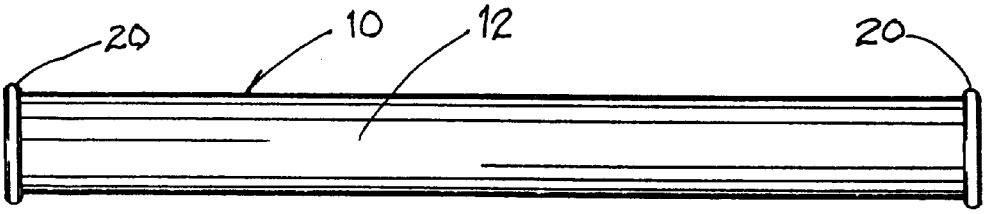

FIG. 38 is a top view of the bag closure shown in FIG. 37.

Figure 39:
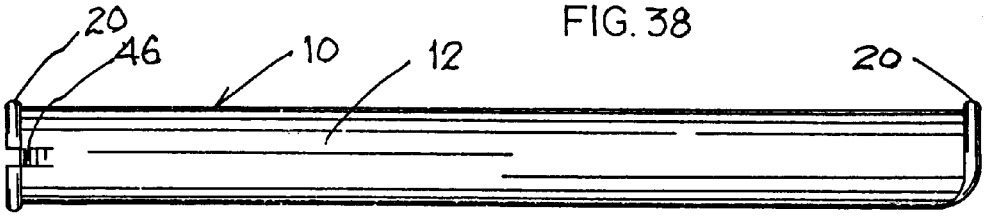

FIG. 39 is a side view of the bag closure shown in FIG. 37.

Figure 40:
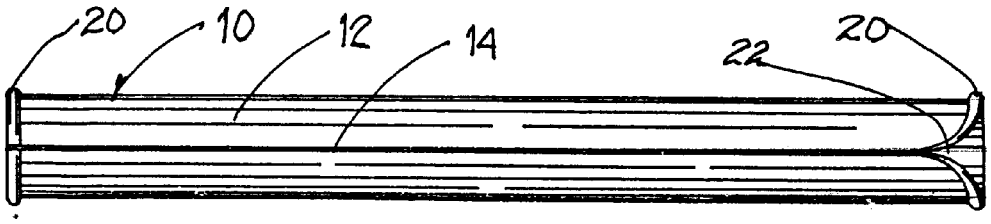

FIG. 40 is a bottom view of the bag closure shown in FIG. 37.

Figure 41:
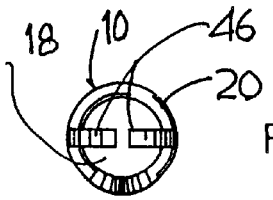

FIG. 41 is a view of the closed end of the bag closure of FIG. 37.

Figure 42:
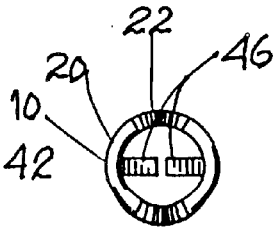

FIG. 42 is a view of a open end of the bag closure of FIG. 37.

DESCRIPTION

FIGS. 1 through 5 show a bag closure 10 embodying features of the invention. The bag closure 10 is formed from a hollow cylindrical tube 12 preferably of a plastic material. The diameter and length of the tube 12 are not critical but may be selected based on the dimensions of the bag to be closed. A slit 14 runs the length of the tube 12 in the plane of and parallel to a central axis 16 passing through the lumen 18 in the tube 12.

In the first embodiment a bead 20 is formed on each end of the tube 12 and the slit 12 is flared at each end to form a notch 22, with the bead 20 running at least a distance along the length of the notch 22 toward the slit 14. The bead 20 is critical to the proper functioning of the bag closure 10. As can best be seen in FIGS. 1, 4 and 5, the slit walls 24,26 on both sides of the slit 14 remain in the same orientation as the unslit tube and the faces of the slit walls 24, 26 are in contact or substantially in contact with each other. The bead 20 functions to hold the tube in its cylindrical orientation. In the absence of the bead 20 the slit walls 24, 26 will either spread apart or one slit wall will slide under the second slit wall significantly reducing the utility of the bag closure. The notch 22 is of assistance in sliding a bag into the closure 10 as it helps to guide the bag material into and along the slit during a closure process.

Figure 1:
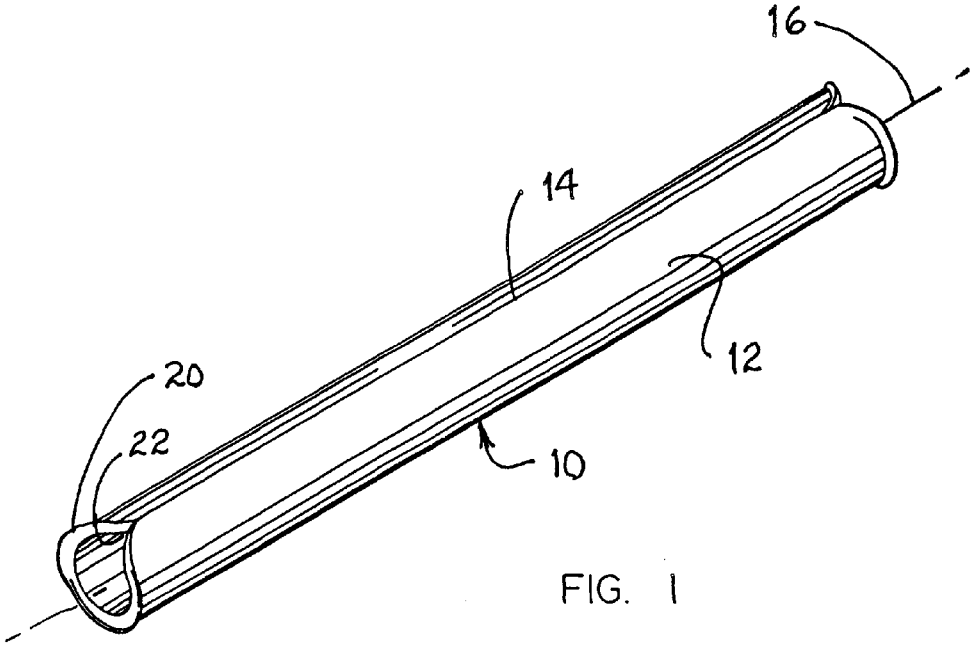
FIG. 1 is a bottom left perspective view of a bag closure incorporating features of the invention.
Figure 2:
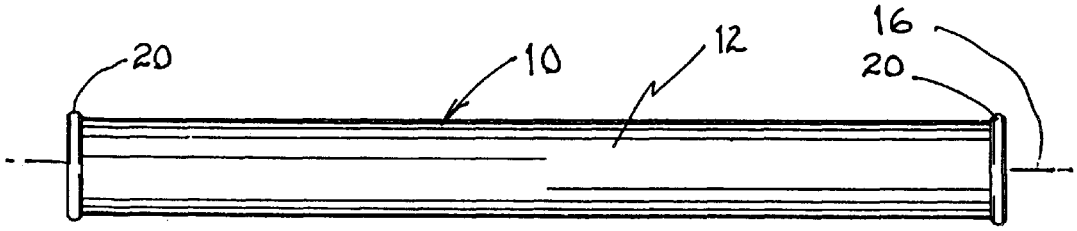
FIG. 2 is a top view of the bag closure shown in FIG. 1.
Figure 3:
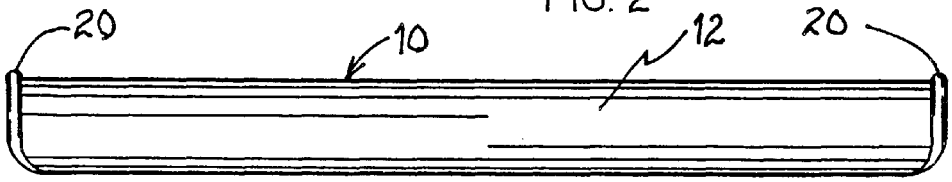
FIG. 3 is a side view of the bag closure shown in FIG. 1.
Figure 4:
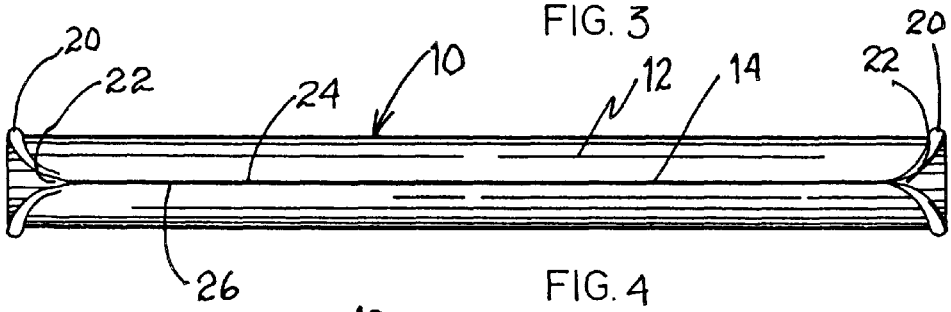
FIG. 4 is a bottom view of the bag closure shown in FIG. 1.
Figure 5:
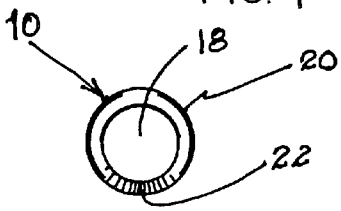
FIG. 5 is an end view of the bag closure shown in FIG. 1, the opposite end being a mirror image thereof.
Figure 7:
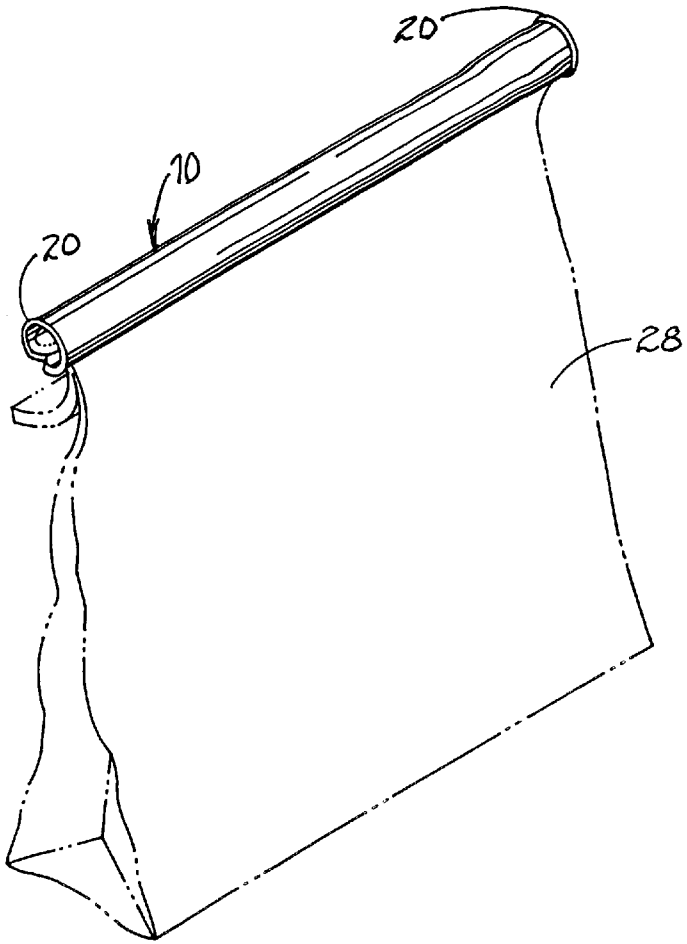
FIG. 7 is a perspective view of the bag closure shown in FIG. 1 after a bag is inserted. The broken line showing of a bag is for illustrative purposes only and does not form part of the invention.
Figure 6:
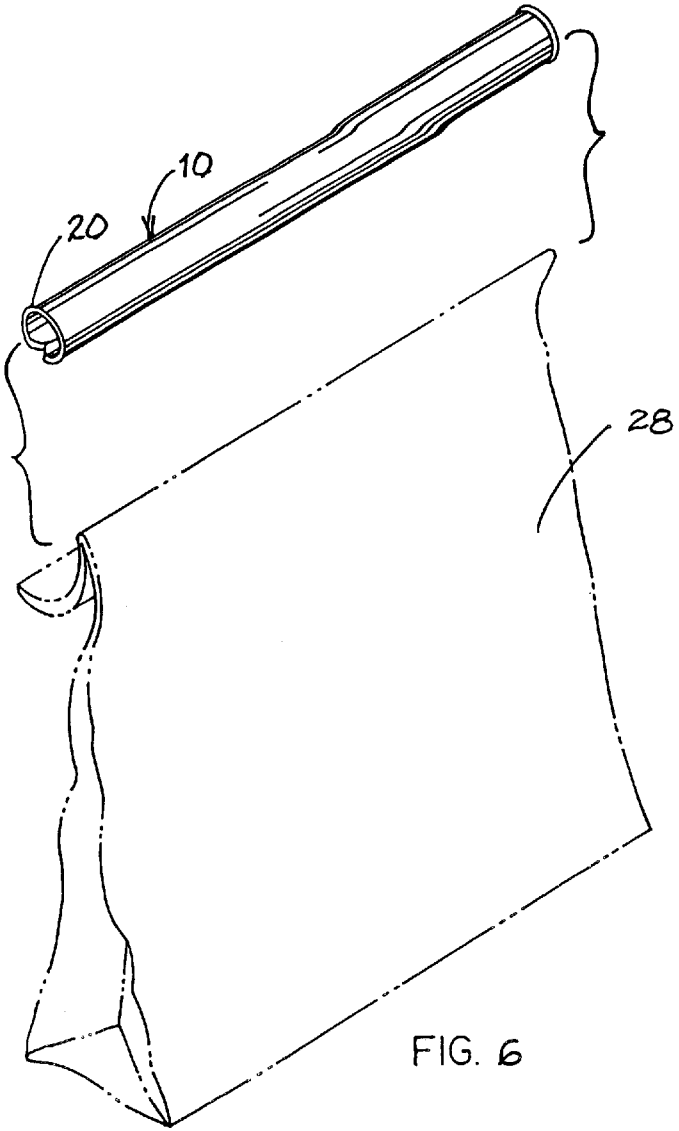
FIG. 6 is a perspective view of the bag closure shown in FIG. 1 before a bag is inserted. The broken line showing of a bag is for illustrative purposes only and doe not form part of the invention.

FIG. 6 shows the bag closure 10 poised above a bag 28 prior to application of the closure. FIG. 7 shows the closure after attachment to a bag 28.

In the additional embodiments like parts are numbered in the same manner as FIGS. 1–6.

FIGS. 8 through 12 show a second embodiment of the bag closure which has an extruded hanging flange 30 formed integral with the tube 12. Penetrating through the flange 30 is a hole 32 for use in hanging the bag closure 10 and the attached bag. Aside from the mounting flange, the embodiment of FIGS. 1–5 is the same as FIGS. 8–12. FIGS. 8–12 show the flange 30 running along the length of the tube in the same plane as, but about 180°, to the slit 14. However, the flange 30 may be mounted along the length of any side of the tube 12. Further, it is not necessary that the flange 30 run the entire length of the tube. However, if the flange is less than the entire length of the tube 12, it is preferred that a portion of the flange be located in the center of the length of the tube 12 so that the bag will hang straight if the hole 32 is used for mounting purposes.

A third embodiment, shown in FIGS. 13–18 and having a torpedo shape, has a first end with a bead 20 and a notch 22. The second end has the notch 22 pressed together to form a rounded, closed end 34 with slit 14 continuing through the closed end. The closed end gives additional stability to the approximation of the sides 24, 26 of the slit 14.

A fourth embodiment, shown in FIGS. 19–24, includes an double adhesive conformal pad 36 mounted along the length of a side of the tube 12 at about 90°. A first layer of adhesive (not shown) attaches the pad 36 to the tube 12. A second layer of adhesive 38 is used to mount the tube 12 to a surface and then attaching a bag in the tube 12 to that surface. until use the adhesive 38 is usually covered by a barrier paper to protect the adhesive 38. The Figures show the pad attached to a side of the tube so that when the bag closure 10 is attached to a vertical surface the bag will hang straight.

A fifth embodiment, shown in FIGS. 25–30, is a closure 10 with magnetic conformal pad 40 having an adhesive on one side to adhere the pad 40 to the closure 10. This embodiment allows temporary mounting of the tube closure 10 to a magnetic surface.

FIGS. 31–36 show a sixth embodiment with an extruded conformal pad 42 having a thin rectangular double adhesive tape 44 on its outer surface.

A seventh embodiment, shown in FIGS. 37–42, includes at least two tabs 46 bent inward at one end of the tube 14. These tabs 46 serve as a stop when the bag 28 is slid along the slit 14 from the notched end. In the seven the embodiment a notch 22 is formed in only one end of the tube 12. However, the bead 20 is still formed on each end.

Each embodiment includes a bead 20 on at least the notched end. This bead can be molded into the tube 14 when formed. However, the preferred procedure is to extrude a tube of the desired diameter and then cut it off to the desired length. The notch 22 is then formed followed by or in conjunction with the formation of the bead 20 by contact with a mandrel heated sufficiently to shape and curl the tube end outward to form a bead. This bead stabilizes the diameter of the tube so that the slit 14 can be cut along the length of the tube by a blade, hot knife or a combination of a blade with a heated surface having a temperature sufficient to form a smooth surface along the slit walls 24, 26.

The tube 14 is preferably extruded from a flexible plastic material such as polyolefins, i.e., polyethylene, polypropylene. Typical lumen 18 diameters are from about ¼ to about 3 inches with the preferred diameter being about 1/32 inch and typical lengths are 1 to 12 inches with the preferred length being about 4 to 8 inches. A typical tube 14 wall thickness is about ⅛ inch. The bead formed on the end of the tube increases the outer diameter of the tube by at least about 1/32 of an inch. However, these dimensions are not critical and can be greater or less without straying from the invention.

Although the present invention has been described in considerable detail with reference to certain preferred versions, manufacturing methods and uses thereof, other versions and uses are possible. For example, the features of the different embodiments can be combined; i.e., the attachment means of the different versions can be applied to or formed on any of the embodiments and finger grips may be added to the surface of the tube 12. Additionally, while extrusion is preferred, the grip can be molded or heat formed using standard plastic processing techniques. Therefore, the spirit and scope of the appended claims should not be limited to the description of the preferred versions contained herein.

What is claimed is:

1. A bag closure comprising a tube of a preselected outer diameter, lumen diameter, wall thickness and length formed from a flexible plastic material, the tube having a first end and a second end spaced from the first end, a slit through the wall of the tube running the length of the tube in the plane of and parallel to, a central axis of the tube passing through the lumen of the tube, at least the first end having a notch formed therein at a point where the slit and first end meet and a bead formed on said first end and along at least a portion of the notch, the bead increasing the outer diameter of the end of the tube, the slit having two opposed lateral edges maintained substantially in contact with each other and the tube being maintained in its cylindrical orientation solely by the presence of the bead, the lateral edges of the slit applying a clamping force on any material placed there between.

2. The bag closure of claim 1 wherein the tube length is from about 1 to about 12 inches, the lumen diameter is from about ¼ to about 3 inches and the wall thickness is at least about 1/32 of an inch and the bead formed on the end of the tube increases the outer diameter of the tube by at least about 1/32 of an inch.

3. The bag closure of claim 1 having a bead and notch on the first and second end.

4. The bag closure of claim 1 having a torpedo shaped second end, the slit extending through the second end.

5. The bag closure of claim 1 having tabs on the second end, the tabs extending into the lumen.

6. The bag closure of claim 1 also having a mounting means attached to the tube.

7. The bag closure of claim 6 wherein the mounting means includes an adhesive outer surface.

8. The bag closure of claim 6 wherein the mounting means includes a magnetic outer surface.

* * * * *